United States Patent [19]

Graff et al.

[11] Patent Number: 4,787,008

[45] Date of Patent: Nov. 22, 1988

[54] ELECTRONIC LATCH CIRCUITRY

[75] Inventors: Timothy Graff, Palatine; Gregory A. Peterson, Barryington, both of Ill.

[73] Assignee: Digital Appliance Controls, Inc., Hoffman Estates, Ill.

[21] Appl. No.: 23,210

[22] Filed: Mar. 9, 1987

[51] Int. Cl.[4] ..... H05B 6/68

[52] U.S. Cl. ..... 361/190; 361/194; 219/10.55 B; 219/10.55 C

[58] Field of Search ..... 361/160, 166, 189, 190, 361/194; 219/10.55 B, 10.55 C

[56] References Cited

U.S. PATENT DOCUMENTS 4,533,810 8/1985 Harmon et al. ..... 219/10.55 B 4,670,810 6/1987 Valeur ..... 361/190

*Primary Examiner*—L. T. Hix

*Assistant Examiner*—David M. Gray

*Attorney, Agent, or Firm*—Buchanan Ingersoll

[57] ABSTRACT

A relay coil associated with a pair of contacts connects an electrical source to a load. Actuation of a coil sensing element by a trigger input signal supplies current to the coil. In response to the trigger input signal the load sensing element supplies a latch maintain signal to a switching element which becomes conductive to establish current flow to the load. As long as the load sensing element detects current to the load the switching element remains conductive for a "latched" state. Interruption of current to the load converts the elements to an "off" state until another trigger input signal is transmitted to the load sensing element.

19 Claims, 4 Drawing Sheets

ELECTRONIC LATCH CIRCUITRY

BACKGROUND OF THE INVENTION

1. Field of the Invention

This invention relates to switching apparatus and more particularly to method and apparatus for maintaining a signal to a switching element conductive in response to current flow through a relay coil and thereby maintain the circuit in a "latched" state until current to the switching element is interrupted.

2. Description of the Prior Art In control systems for household appliances, such as microwave ovens and the like, switching or startup apparatus is used to allow the microcontroller to terminate rather than initiate current to the coil of a relay. With this arrangement the relay coil current is initiated by momentary closure of a "start" pad on a touch control panel to generate a latch trigger pulse to a switching element. Conventionally a relay controlled coil is connected in series with a contact pair. The switching element, such as a transistor, is placed in parallel with the contact pair. The trigger pulse is applied to the switching element by momentarily depressing the start pad on the keyboard of the appliance. The switching element upon receipt of the trigger pulse becomes conductive to provide current flow through the coil. As a result the contact pair in series with the coil closes. The coil current is then maintained by switching of the relay coil contacts to a "latched" state until the current to the coil is terminated.

With the above described prior art device a problem is encountered in depressing the "start" pad on the touch control panel for a shorter interval of time than required to close or "pull-in" the relay contacts to establish current flow through the relay coil. The "start" switch is depressed and released before a latched condition is established. Therefore, it is necessary to monitor the relay coil with an "on" sense signal to detect incomplete startup.

It is also well known with conventional latch circuits for solid state appliance controls that the presence of relatively small amounts of moisture can develop corrosion on the latching relay contacts. Corrosive deposits on the contacts prevent latching of the relay coil. Increasing the contact closing potential and gold plating the latching contacts are measures taken to overcome this corrosion problem. The apparent disadvantage of these corrective measures is the associated increase in cost of manufacture.

Therefore, there is need to improve the efficiency of switching apparatus for electronic latch circuits by eliminating the relay "on" sense signal to insure latching of the relay for preventing incomplete startup due to rapid operation of the start control. While attempts have been made to overcome the problems associated with corrosion bulldup on the contacts, more cost efficient measures are needed to increase the overall performance of the switching circuitry and reduce the circuit complexity.

SUMMARY OF THE INVENTION

In accordance with the present invention there is provided electronic circuitry for maintaining current flow to an electronic load that includes a load sensing element connecting the electrical load to an energy source where the circuitry is normally maintained in an off state. The normally nonconductive load sensing element is switched to a conductive state upon receipt of an input signal from a current-voltage source to permit current flow to the electrical load and initiate a latch signal. A switching element is connected to the load sensing element and the electrical load. The switching element is normally nonconductive and is switched to a conductive state upon receipt of the latch signal. The switching element while in a conductive state maintains current flow through the electrical load to convert the circuitry from an off state to a latched state.

Further in accordance with the present invention, there is provided a method for establishing a latched state of a control circuit for an electrical load that includes the steps of transmitting a latch input signal to the control circuit. Current flow to the electrical load is initiated in response to the latch input signal. Upon detection of the flow of current through the electrical load a latch maintain signal is generated. The latch maintain signal is transmitted to a switching element. The switching element is converted from a nonconductive state to a conductive state to maintain steady state current flow through the electrical load. The latch maintain signal to the switching element is maintained by the presence of current flow through the electrical load to retain the control circuit for the electrical load in a latched state.

An additional feature of the present invention includes apparatus for maintaining a latched condition of a control circuit having a pair of contacts. A relay coil associated with the contacts connects an electrical source to a load. The contacts are normally maintained nonconductive for an off condition of the control circuit. Sensing means detects the flow of current to the relay coil. Means for generating a latch trigger input signal to the sensing means actuates the sensing means to allow current flow from the electrical source to the relay coil. Switching means connected to the relay coil and the sensing means is normally maintained in a nonconductive state. A latch maintain signal is transmitted from the sensing means to the switching means in response to current flow to the relay coil. The switching means is converted to a conductive state upon receipt of the latch maintain signal. The contacts of the relay coil are closed upon actuation of the switching means to a conductive state to establish current flow to the load and maintain a latched condition of the control circuit.

Accordingly, the principal object of the present invention is to provide electronic latch circuitry for maintaining a latched condition in a control circuit as long as current is supplied to the load.

Another object of the present invention is to provide switching apparatus for latching a relay coil by actuation of semiconductors in response to either a current pulse or a low voltage pulsed, input signal.

A further object of the present invention is to provide instantaneous latching of current to a load upon detection of current flow to the load.

These and other objects of the present invention will be more completely disclosed and described in the following specification, the accompanying drawings and appended claims.

DESCRIPTION OF THE PREFERRED EMBODIMENTS

Figure 1:
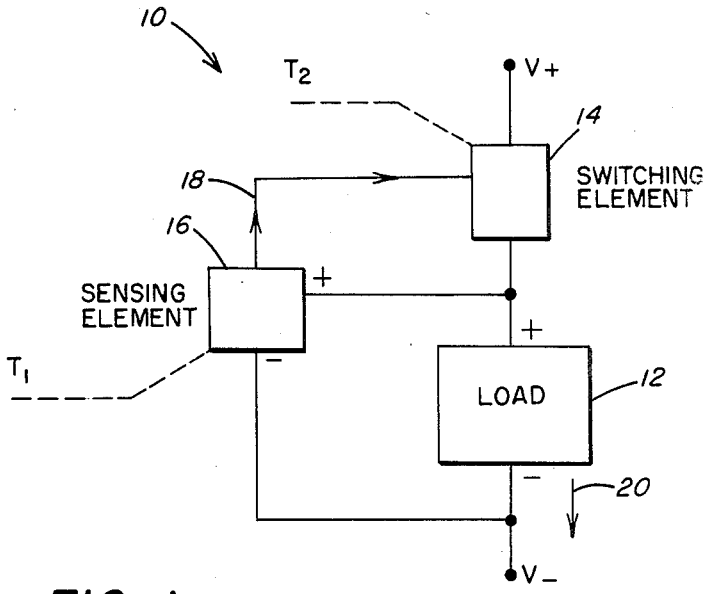
FIG. 1 is a schematic illustration of an electronic latch circuit, illustrating energization of a load from a positive voltage supply.
Figure 2:
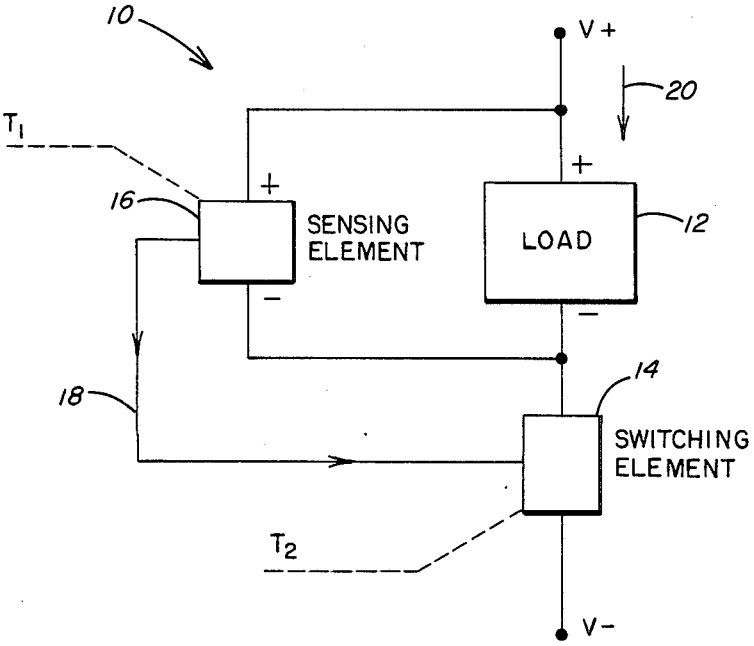
FIG. 2 is a schematic illustration similar to FIG. 1 in which the load is applied from a negative voltage supply.

Referring to the drawings and particularly to FIGS. 1 and 2, there is illustrated an electronic latch circuit generally designated by the numeral 10 used in the on-off control circuit of an appliance, such as a microwave oven. A load 12 is placed in series with either a current controlled or voltage controlled switching element 14. A load sensing element 16 is connected in parallel to the load 12. The switching element 14 is connected to the load sensing element 16 by conductor 18. As illustrated in FIG. 1, the switching element 14 is connected to the positive potential side of the load 12. In FIG. 2 the same switching element 14 is connected to the negative potential side of the load 12.

To initiate a "latched" state of the load a low voltage trigger pulse $T_1$ is inputed to the load sensing element 16, or a trigger pulse $T_2$ can also be inputed to the switching element 14. The presence of either trigger pulse $T_1$ or $T_2$ generates current to flow to the load 12 in the direction indicated by arrow 20.

The current to the load 12 is detected by the load sensing element 16 which is, in turn, actuated to generate a latch maintain signal. This signal is transmitted from the load sensing element 16 through conductor 18 to the switching element 14. The presence of the latch maintain signal at the switching element 14 switches the element 14 from a normally nonconductive state to a conductive state to maintain the "latched" state and current flow in the direction indicated by the arrow 20.

As long as current is maintained through the load 12 in sufficient magnitude to be detected by the load sensing element 16, the load sensing element maintains transmission of the latch signal to the switching element 14. In this manner the circuit 10 is maintained in a "latched" state. The "latched" state continues until the current to the load 12 is interrupted.

Upon interruption of current to the load the circuit reverts to an off or "unlatched" state until trigger pulses $T_1$ or $T_2$ are once again initiated from a voltage source (not shown). Thus, while the electronic latch circuit 10 is operable to terminate relay coil current, it can not initiate flow of current to the load. Current to the load can only be initiated by depressing the start pad on the touch control pad. Depressing the start pad initiates the trigger pulse inputs.

Figure 3:
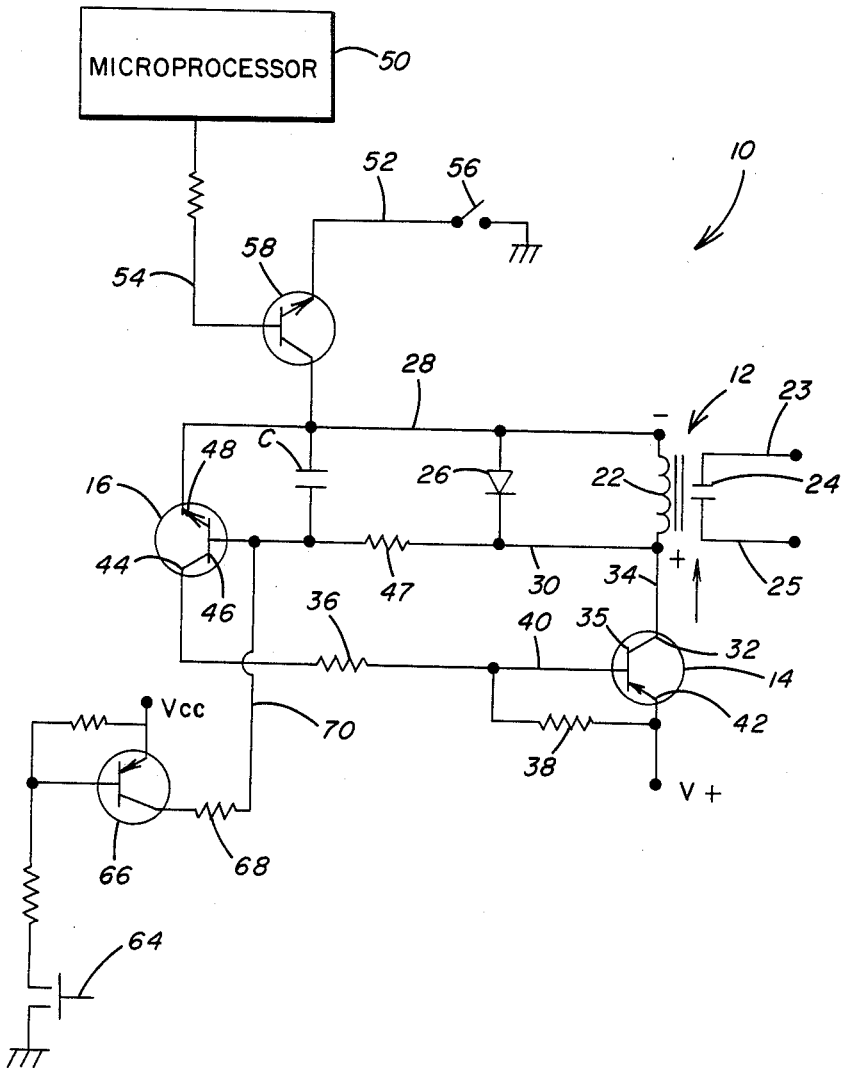
FIG. 3 is a more detailed schematic of the electronic latch circuit shown in FIG. 1.
Figure 4:
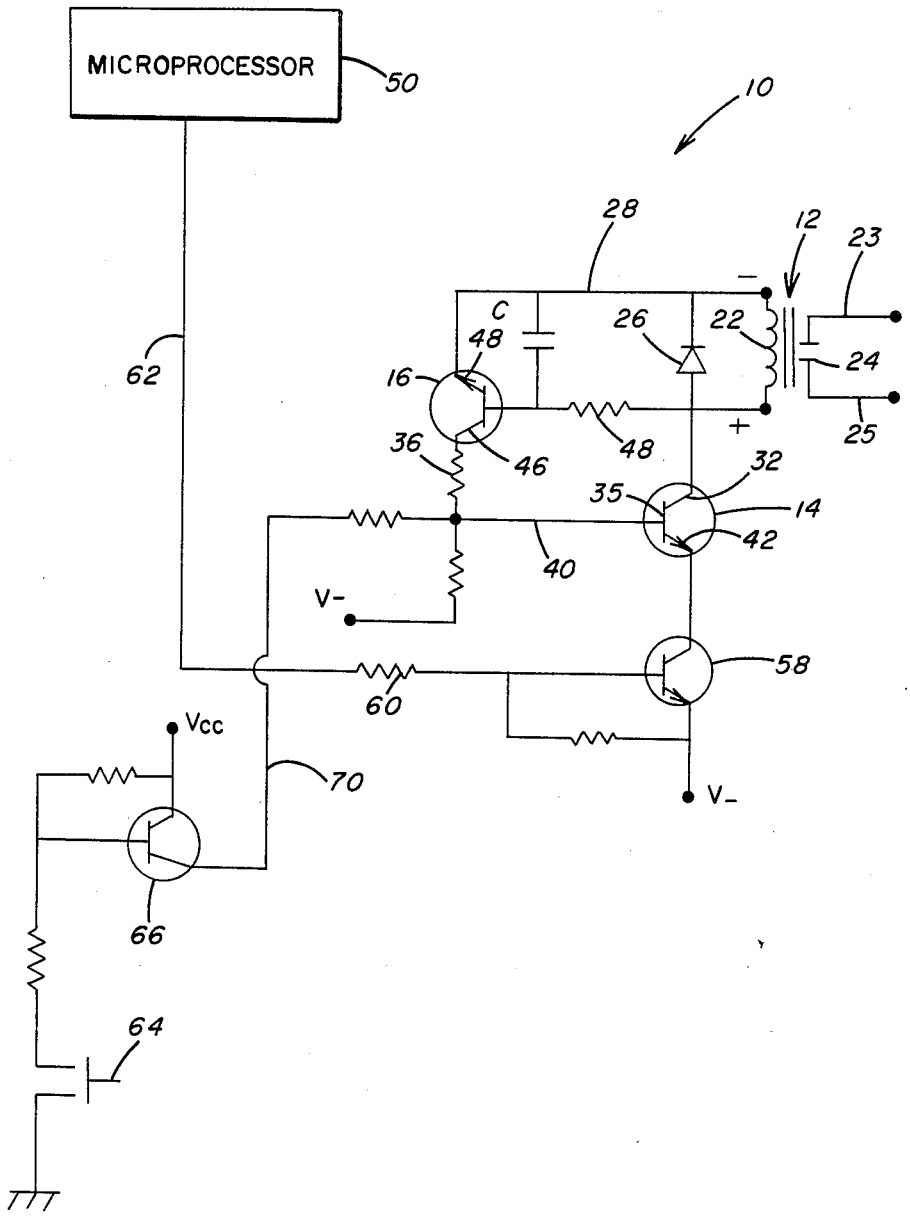
FIG. 4 is a more detailed schematic of the electronic latch circuit shown in FIG. 2.

Now referring to FIGS. 3 and 4 in which like numerals in FIGS. 3 and 4 designate like parts in FIGS. 1 and 2. The electronic latch circuit 10, illustrated in FIG. 3, corresponds to the schematic shown in FIG. 1 in which the load sensing element 16 is connected to the positive voltage side of the load 12. In FIG. 3 a coil 22 is associated with a pair of contacts 24 connected by conductors 23 and 25 to a relay controlled load (not shown). A diode 26 is positioned in parallel relation to the coil 22 between conductors 28 and 30. Preferably the switching element 14 is a transistor having a collector 32 connected by conductor 34 to the positive voltage side of coil 22, a base 35 connected by conductor 40 to resistors 36 and 38, and an emitter 42.

The load sensing element 16 is preferably a transistor having a collector 44 connected by conductor 40 to the base 34 of the switching element or transistor 14. A base 46 is connected through a resistor 47 to conductor 30, and an emitter 48 is connected through conductor 28 to the negative potential side of coil 22.

With this arrangement a low voltage trigger pulse is inputed from a microprocessor generally designated by the number 50 associated with the touch control panel of an appliance, such as a microwave oven. The microprocessor 50 is connected through conductor 54 to a transistor 58 associated with a grounded door switch 56 of the appliance. The circuit 10 will only latch when the door switch 56 is closed corresponding to the door of the appliance being closed and transistor 58 is in a conductive state.

With the door switch 56 closed and transistor 58 in a conductive state depressing a "start" pad on 64 the appliance touch control pad transmits a trigger pulse from a power source to switch a transistor 66 from a nonconductive state to a conductive state. Transistor 58 is connected through resistor 68 by conductor 70 to base 46 of transistor 16. From transistor 66 the latch trigger input signal $T_1$ as discussed above with reference to FIG. 1 is received by transistor 16. The input signal $T_1$ switches the transistor 16 to a conductive state to supply a latch maintain signal through conductor 40 to the switching element or transistor 14. In addition, actuation of transistor 58 enables current flow to the coil 22 of load 12. In this manner the flow of current to the coil 22 is established. On the other hand, opening the door switch 56 converts transistor 58 to a nonconductive state to terminate current flow to coil 22.

Current flow to the coil 22 is detected by the transistor 16. Current flow through the coil 22 is maintained as long as the transistor 16 remains conductive. Accordingly, the transistor 14 remains conductive as long as the transistor 16 transmits a latch maintain signal to base 35 of transistor 14. Once the transistor 16 is energized, current flow will continue through the coil 22 to obtain the "latched" state of the latch circuit 10.

In the event current to the coil 22 should be interrupted as by opening the door switch 56 or transistor 58 becoming nonconductive, the transistor 16 switches or changes to a nonconductive state. In this manner the latch maintain signal is terminated thereby switching the transistor 14 to an "off" state. However, closure of the door switch 56, once it has been opened or transistor 58 becoming conductive will not initiate the coil current.

The coil current can only be initiated by depressing the "start" pad 64 of the appliance touch control panel. The transistor 16 serves to maintain the "latched" state of the circuit 10 regardless of the rapid actuation of the "start" pad 64. However once flow of current to or potential difference across the coil 22 is terminated, the latch circuit 10 is turned off.

Now referring to FIG. 4, there is illustrated the details of the embodiment of the electronic latch circuit 10 corresponding to the configuration shown in FIG. 2 in which the switching element or transistor 14 is connected to the negative side of the coil 22 of load 12. As with the above-described arrangement, the main switching transistor 58 is connected through resistor 60 and conductor 62 to microprocessor 50.

As above described, when the door switch (not shown in FIG. 4) is closed and the "start" pad 64 is depressed, current to the base of transistor 66 switches the transistor 66 to a conductive state. Transistor 66 inputs a low voltage trigger pulse, corresponding to $T_2$ as described above with reference to FIG. 2, to the switching element or transistor 14 which thereby initiates current flow through the coil 22. The presence of current through the coil 22 switches the load sensing element on transistor 16 to a conductive state. This initiates the latch maintain signal to actuate the switching element or transistor 14 to maintain the "latched" condition of the circuit 10.

The instant that current is supplied to coil 22, the transistors 14 and 16 are actuated to establish the "latched" state. Thus, if the "start" pad on the touch control panel is only instantaneously pressed, sufficient current is present to actuate the transistors 16 and 14. There is no requirement that the "start" pad 64 be depressed for any required period of time to insure that the "latched" state is maintained.

With the present invention, the "latched" state is established instantaneously upon detection of current to the coil 22 by the transistor 16. In this manner the startup procedure for the appliance is substantially improved by removing the minimum trigger pulse width requirement.

Figure 5:
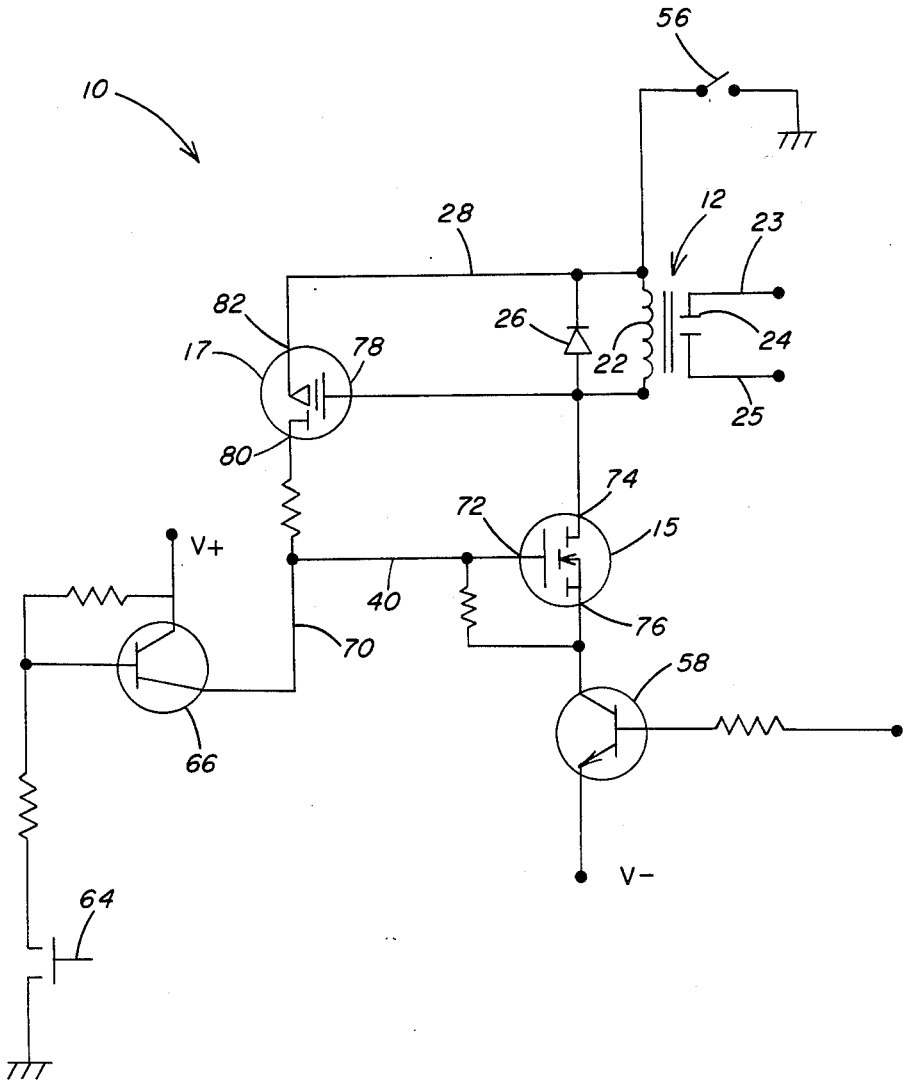
FIG. 5 is a schematic illustration similar to FIG. 4 of a latch circuit using a voltage sensing devise.

Now referring to FIG. 5 in which like numerals refer to like parts described above in reference to FIGS. 3 and 4, field effect transistors (FET) 15 and 17 are used in place of the transistors 14 and 16 respectively. With this arrangement the FET 15 includes a gate terminal 72 conducted by conductor 40 to conductor 70. A drain terminal 74 is connected to the coil on load 22. A source terminal 76 is connected to transistor 58. FET 17 also includes the same terminals 78, 80 and 82 respectively.

The FET 15 senses voltage across load 22 rather than the current through the load 22. In this respect the load 22 can be substituted by a resistor in series with a switching element. The switching element could be open and still the circuit 10 would latch and unlatch normally.

In operation the FET 17 senses voltage across load 22 when the voltage applied to transistor 66 exceeds the threshold voltage of FET 17. FET 17 conducts resulting in an increase of the voltage applied to FET 15 thereby switching FET 15 to a conductive state. This maintains a voltage applied to the circuit 10.

By use of semiconductor switching and load sensing elements 14 and 16 in the electronic latch circuit 10, the adverse affects of corrosion caused by exposure of the microprocessor control to moisture are substantially eliminated. Cost reductions are experienced due to elimination of the components required in the conventional latch circuits such as the second contact pair discussed above. Also rendered unnecessary is increasing the contact potential or gold plating the latching contacts to resist the adverse affects of corrosion.

Accordingly to the provisions of the patents statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. Electronic circuitry for maintaining current flow to or voltage potential across an electrical load comprising, a load sensing element connected to the electrical load to detect transmission of a signal from an energy source where the circuitry is normally maintained in an off state, said load sensing element being normally nonconductive switched to a conductive state upon receipt of an input signal from a current-voltage source to permit current flow to the electrical load and initiate a latch signal, a switching element connected to said load sensing element and the electrical load, said switching element being normally nonconductive switched to a conductive state upon receipt of the latch signal from said load sensing element, said load sensing element maintaining the latch signal to said switching element for the duration of time said load sensing element detects current flow or voltage potential across the load, and said switching element in a conductive state maintaining current flow through the electrical load to convert the circuitry from an off state to a latched state.

2. Electronic circuitry as set forth in claim 1 in which, said switching element remains conductive in the presence of the latch signal from said load sensing element.

3. Electronic circuitry as set forth in claim 1 in which, said load sensing element is switched from a conductive state to a nonconductive state upon interruption of current flow to or removal of voltage potential from the electrical load.

4. Electronic circuitry as set forth in claim 1 in which, said switching element is switched to a nonconductive state in response to termination of the latch signal from said load sensing element when current flow to the load is interrupted whereby the circuitry is converted from a latched state to an off state.

5. A method for establishing a latched state of a control circuit for an electrical load comprising the steps of, transmitting a latch input signal to the control circuit, actuating a switching element in response to the latch input signal to initiate a signal to the electrical load, converting the switching element on receipt of the latch input signal form a nonconductive state to a conductive state, detecting the signal to the electrical load to generate a latch maintain signal, instantaneously transmitting the latch maintain signal to the switching element upon receipt of the initial signal to the electrical load to maintain the switching element conductive, maintaining steady state current flow through the switching element to the electrical load, and maintaining the latch maintain signal to the switching element for the duration of time current flow or voltage potential across the electrical load is detected to retain the control circuit for the electrical load in a latched state.

6. A method as set forth in claim 5 which includes, interrupting current flow to or removing the voltage potential across the load to terminate the latch maintain signal to the switching element and convert the control circuit from a latched state to an off state.

7. A method as set forth in claim 6 which includes, returning the control circuit to a latched state upon transmission of the latch input signal to the control circuit.

8. A method as set forth in claim 5 which includes, terminating the latched state of the control circuit by interrupting current flow to the electrical load.

9. A method as set forth in claim 5 which includes, detecting current flow to or voltage potential across the electrical load by a load sensing element to initiate the latch maintain signal.

10. A method as set forth in claim 5 which includes, maintaining transmission of the latch maintain signal to the switching element by a load sensing element as long as current of a preselected magnitude is maintained through the load for detection by the load sensing element.

11. A method as set forth in claim 5 which includes, triggering a low voltage pulse signal to a load sensing element to initiate the latch maintain signal to the switching element.

12. A method as set forth in clalm 5 which includes, sensing the flow of current to or voltage potential across the electrical load by a load sensing element, switching the load sensing element from a nonconductive state to a conductive state in the presence of current flow to or potential across the electrical load to generate the latch maintain signal, and directing the latch maintain signal from the load sensing element to the switching element to maintain the switching element in a conductive state for the latched state of the control circuit.

13. Apparauts for maintaining a latched condition of a control circuit comprising, a pair of contacts, a relay coil associated with said contacts for connecting an electrical source to a load, said contacts being normally maintained nonconductive for an off condition of the control circuit, sensing means for detecting the flow of current to said relay coil, means for generating a latch trigger input signal to said sensing means to actuate said sensing means to allow current flow from the electrical source to said relay coil, switching means connected to said relay coil and said sensing means, said switching means being normally maintained in a nonconductive state, a latch maintain signal transmitted from said sensing means to said switching means in response to current flow to said relay coil, said switching means maintained in a conductive state upon receipt of said latch maintain signal in response to current flow to said relay coil, and said contacts of said relay coil being closed upon actuation of said switching means to a conductive state to establish current flow to the load and maintain a latched condition of the control circuit.

14. Apparatus as set forth in claim 13 which includes, said switching means connected to the negative potential side of the load.

15. Apparatus as set forth in claim 13 which includes, said switching means connected to the positive potential side of the load.

16. Apparatus as set forth in claim 13 which includes, said latch trigger input signal transmitted to said sensing means for maintaining said switching means in a conductive state to sustain current flow to the load and transmitting of said latch maintain signal.

17. Apparatus as set forth in claim 13 in which, said sensing means includes a transistor connected across said relay coil, and said transistor being switched from a normally nonconductive state to a conductive state upon the application thereto of a low voltage pulsed latch trigger input signal.

18. Apparatus as set forth in claim 13 in which, said switching means includes a transistor connected to said relay coil, and said transistor being switched from a normally nonconductive state to a conductive state upon receipt of said latch maintain signal to maintain the latched condition until current to said relay coil is interrupted.

19. Apparatus as set forth in claim 13 in which, said sensing means maintains said latch maintain signal to said switching means as long as said sensing means detects current flow to said relay coil.

* * * * *